US007373925B2

(12) United States Patent
Reiter et al.

(10) Patent No.: US 7,373,925 B2
(45) Date of Patent: May 20, 2008

(54) COMPENSATING ELEMENT FOR A FUEL INJECTOR

(75) Inventors: Ferdinand Reiter, Markgroeningen (DE); Martin Scheffel, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/569,295

(22) PCT Filed: Jul. 7, 2004

(86) PCT No.: PCT/DE2004/001452

§ 371 (c)(1),
(2), (4) Date: Mar. 23, 2007

(87) PCT Pub. No.: WO2005/021956

PCT Pub. Date: Mar. 10, 2005

(65) Prior Publication Data

US 2007/0228662 A1 Oct. 4, 2007

(30) Foreign Application Priority Data

Aug. 22, 2003 (DE) ..... 103 38 715

(51) Int. Cl.
*F02M 61/14* (2006.01)
*F02M 61/18* (2006.01)

(52) U.S. Cl. ..... 123/470; 123/467

(58) Field of Classification Search ..... 123/470, 123/467, 468, 469, 456; 239/533.11, 600; 277/591

See application file for complete search history.

(56) References Cited

U.S. PATENT DOCUMENTS

| | | | | |
|---|---|---|---|---|
| 4,829,965 | A | 5/1989 | Gartner et al. | |
| 5,247,918 | A | 9/1993 | Wakeman | |
| 5,954,343 | A | 9/1999 | Fukutomi et al. | |
| 6,186,123 | B1 * | 2/2001 | Maier et al. | 123/470 |
| 6,257,594 | B1 * | 7/2001 | Halling et al. | 277/644 |
| 6,289,876 | B1 | 9/2001 | Mackert | |
| 6,446,978 | B1 * | 9/2002 | Halling et al. | 277/626 |
| 6,640,784 | B1 * | 11/2003 | Sims, Jr. | 123/470 |
| 6,745,956 | B1 * | 6/2004 | Bantle et al. | 239/533.3 |
| 2003/0154961 | A1 * | 8/2003 | Liskow | 123/470 |
| 2005/0066941 | A1 * | 3/2005 | Berger et al. | 123/470 |
| 2007/0175451 | A1 * | 8/2007 | Beardmore | 123/470 |

FOREIGN PATENT DOCUMENTS

| | | |
|---|---|---|
| DE | 100 27 662 | 12/2001 |
| DE | 100 38 763 | 2/2002 |
| DE | 101 08 466 | 9/2002 |
| EP | 0 825 342 | 2/1998 |
| GB | 1 299 819 | 12/1972 |
| JP | 11 210886 | 8/1999 |
| JP | 2000 027736 | 1/2000 |
| WO | WO 01/18386 A1 * | 3/2001 |

* cited by examiner

*Primary Examiner*—Mahmoud Gimie
(74) *Attorney, Agent, or Firm*—Kenyon & Kenyon LLP

(57) ABSTRACT

A compensating element for supporting a fuel injector in a cylinder head of an internal combustion engine has an annular design and is situated between a valve housing of the fuel injector and a wall of a receiving bore of the cylinder head. The compensating element includes at least two side pieces, which are supported on the fuel injector and the cylinder head.

15 Claims, 6 Drawing Sheets

COMPENSATING ELEMENT FOR A FUEL INJECTOR

FIELD OF THE INVENTION

The present invention is based on a compensating element for a fuel injector.

BACKGROUND

From the German Patent German Published Patent Application No. 100 38 763 a compensating element is known which has a rigid first ring able to be placed around the circumference of the fuel injector, and a rigid second ring which is insertable into the receiving bore of the cylinder head. An elastomeric intermediate ring situated between the two rigid rings is permanently connected to the first rigid ring and the second rigid ring.

In addition, a compensating element for a fuel injector that is used to mount and support a fuel injector in a cylinder head of an internal combustion engine is known from the German patent German Published Patent Application No. 101 08 466. It is in the form of an annular washer and arranged between a valve housing and a wall of a receiving bore of the cylinder head. The annular washer has a round or oval cross section and sets apart a shoulder of the valve housing from a shoulder of the cylinder head.

A special disadvantage of the compensating elements known from the aforementioned printed publications is the lack of a resulting compact design.

SUMMARY OF THE INVENTION

In contrast to the related art, the compensating element for a fuel injector according to the present invention has the advantage that the compensating element in cross section has at least two side pieces that rest against the cylinder head and the fuel injector.

The compensating element compensates both for manufacturing tolerances of the individual components and for tolerances that are caused by the warming of the fuel injector during operation, so that twisting and misalignments are prevented.

It is advantageous, in particular, that various cross-sectional forms are possible as long as at least one contact surface is available at the cylinder head and the fuel injector, respectively.

This allows for various shapes of the compensating element such as rolled or v-shaped cross sections or cross sections that are folded over multiple times.

Furthermore, it is advantageous that an angle between the fuel injector and the compensating element is virtually freely selectable, preferably in the range between 30° and 60° and—especially preferred—between 35° and 55°, which makes manufacturing tolerances and deviations irrelevant.

Various modifications such as cut-outs, undercuts, beadings etc. may advantageously be provided on the compensating element to model the characteristic which, in an especially advantageous manner, is a progressive characteristic.

It is also advantageous if segments are formed, by punching out and bending, via which the compensating element is supported on the fuel injector. The compensating element may then be preassembled on the fuel injector.

DETAILED DESCRIPTION

Figure 1:
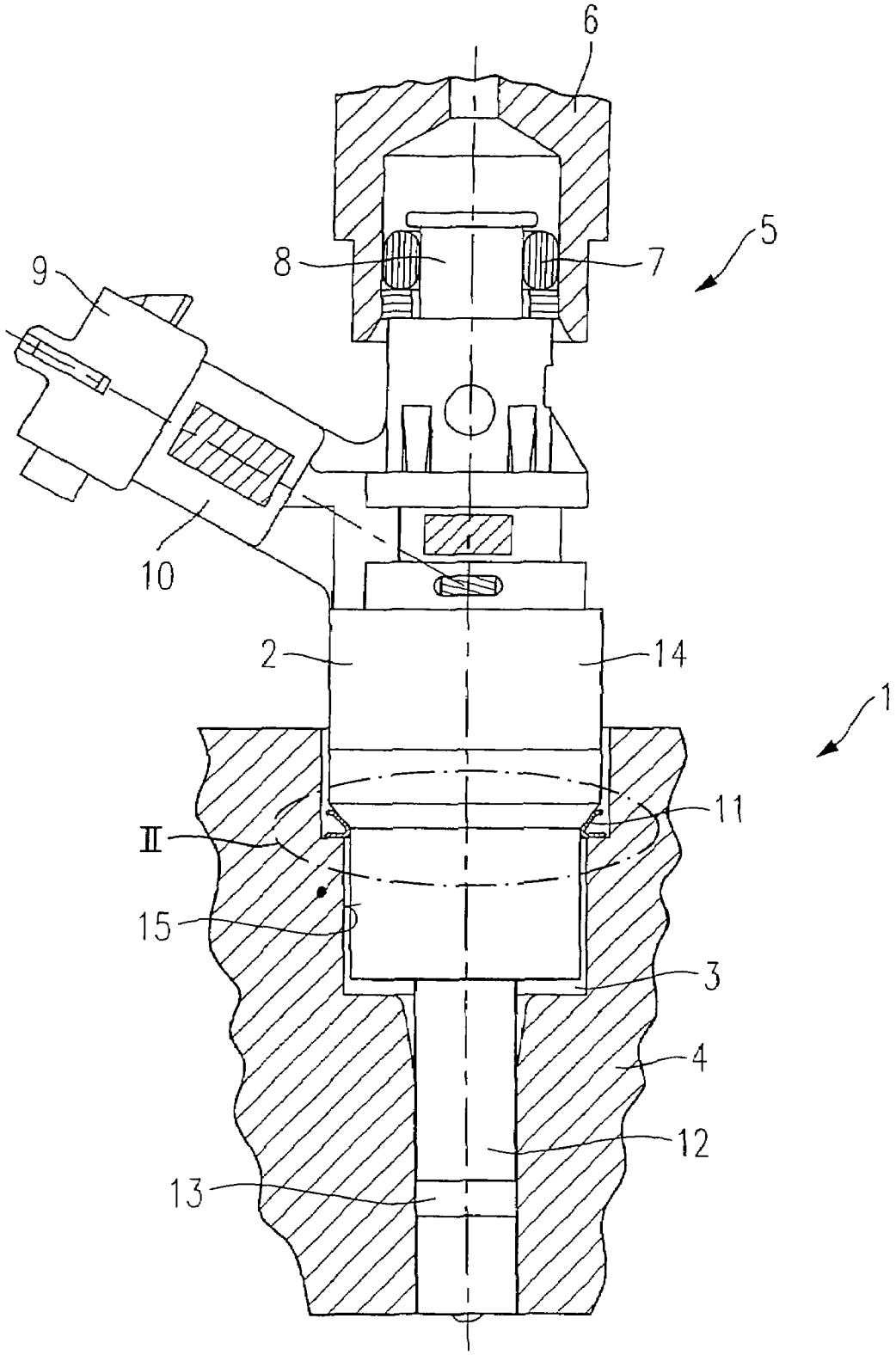
FIG. 1 shows a schematic overall view of an exemplary embodiment of a fuel injector which is mounted in a cylinder head of an internal combustion engine with the aid of a compensating element configured according to the present invention.

FIG. 1 shows a schematized and simplified view of a fuel-injection system 1 that includes a fuel injector 2 which is inserted in a receiving bore 3 of a cylinder head 4 of an internal combustion engine.

In this case, a fuel injector 2 is designed in the form of a directly injecting fuel injector 2, which may be used for the direct injection of fuel into a combustion chamber of the mixture-compressing internal combustion engine (not shown further) having external ignition. At an end 5 on the inflow side, fuel injector 2 is provided with a plug connection to a fuel-distributor line 6, which is sealed by a seal 7 between fuel-distributor line 6 and a supply connection 8 of fuel injector 2. Fuel injector 2 has an electrical connection 9 for the electrical contacting to actuate fuel injector 2. At least on the section that projects beyond cylinder head 4, fuel injector 2 is provided with a plastic extrusion coat 10 that also encloses electrical connection 9.

Fuel injector 2 is held in place in cylinder head 4 and protected from twisting by measures not shown further, such as a clamping shoe. An annular compensating element 11 is provided in receiving bore 3 to center and support fuel injector 2. Compensating element 11 has an approximately v-shaped cross-section and ensures reliable tolerance compensation of fuel injector 2 in all degrees of freedom. Compensating element 11 according to the present invention will be described in greater detail in the following.

A sealing ring 13 which seals fuel injector 2 from cylinder head 4 of the internal combustion engine is provided on nozzle body 12 of fuel injector 2.

Figure 2A:
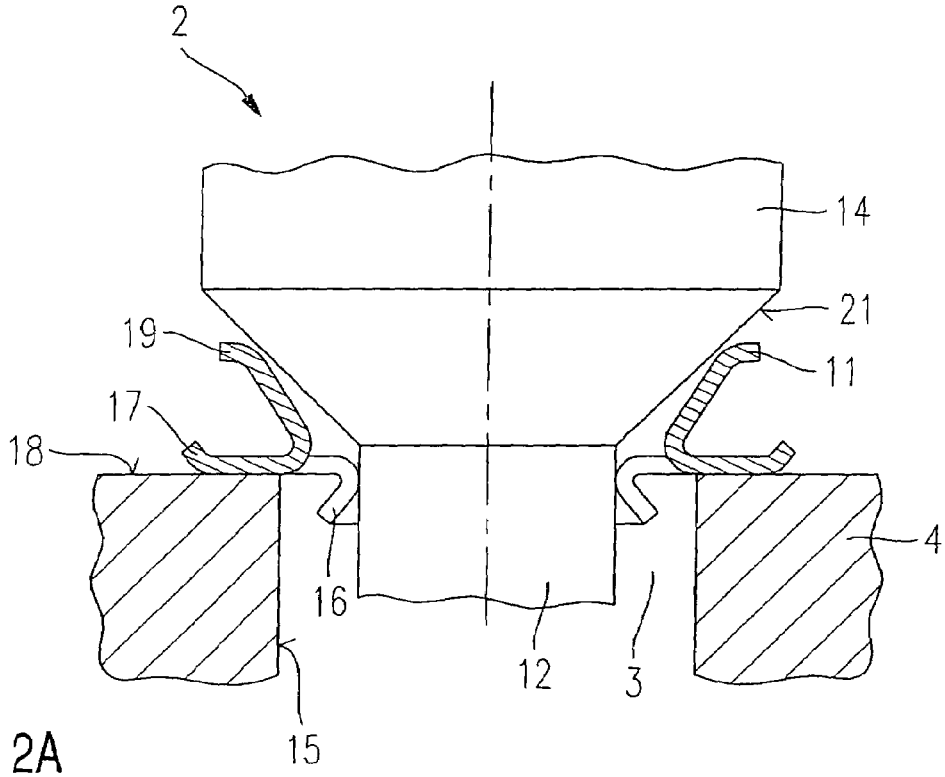
FIGS. 2A-C shows cut-away portions in region II in FIG. 1 in various load states of a compensating element configured according to the present invention.
Figure 2B:
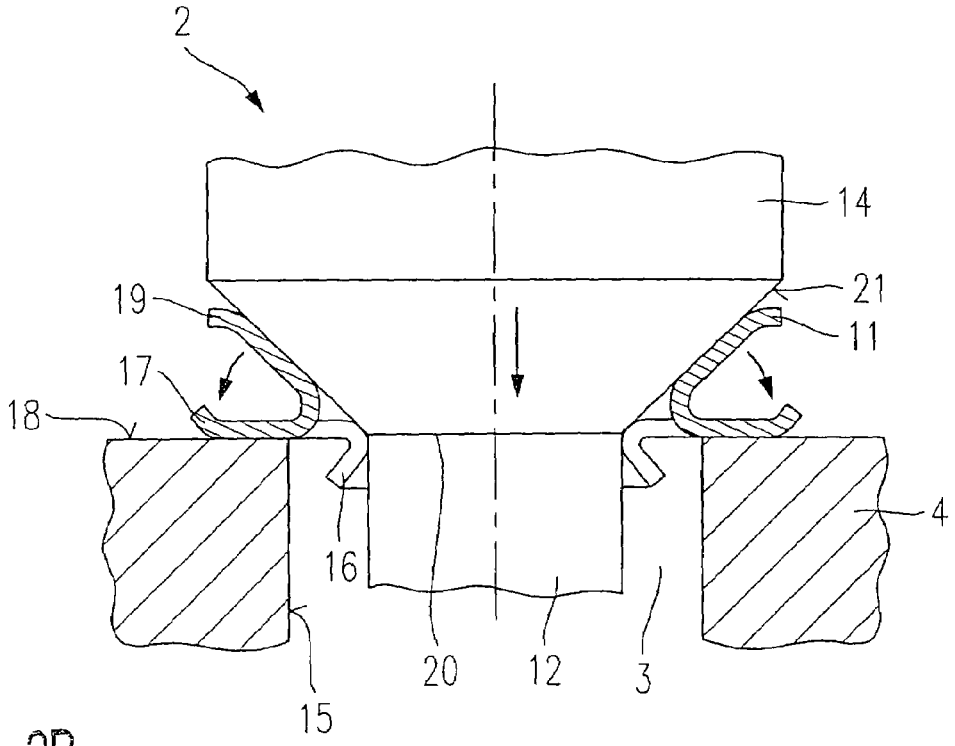
Figure 2C:
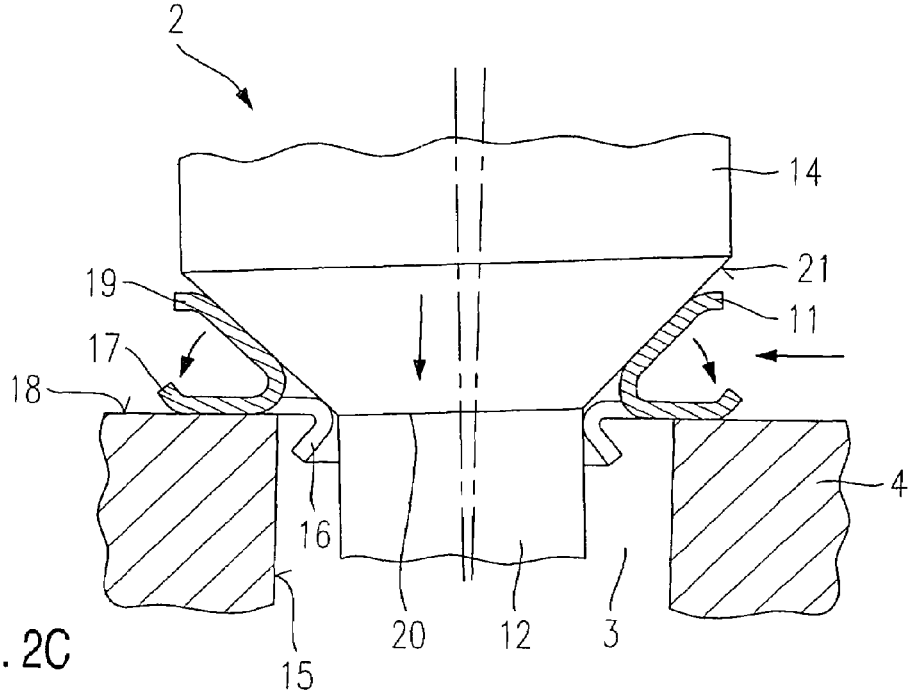

FIGS. 2A to 2C, in the cut-away portion designated II in FIG. 1, show a schematic illustration of the first exemplary embodiment of a compensating element 11 configured according to the present invention in various loaded and unloaded states.

Fuel injectors 2 are usually rigidly installed in cylinder head 4 of internal combustion engines and fixed in place and also guided by an intermediate sleeve which connects fuel injector 2 to fuel-distributor line 6. Lateral offsets of fuel injector 2 are able to be compensated in this manner. However, if fuel injector 2 is to be installed without an intermediate sleeve, the tolerances must be compensated in some other way. Also, it is not sufficient to compensate only lateral offsets or tilting, but thermal changes during the operation of the internal combustion engine must be taken into account as well. Furthermore, it is desirable that compensating element 11, which is to compensate for the various tolerances, be connectable to fuel injector 2 in a non-permanent manner and, at the same time, be supported at an inner wall 15 of cylinder head 4 in a manner that allows an approximately even distribution of the load capacity.

The aforementioned demands are satisfied by a compensating element 11 which is configured according to the present invention and designed in the form of a stamped-out, bent component. As can be gathered from FIGS. 2A to 2C, compensating element 11 has an asymmetrical v-shaped cross-section that includes segments 16. Segments 16 are cut out of compensating element 11 by stamping and then bent, so that they are supported on fuel injector 2 and fixate compensating element 11 thereon. In this way fuel injector 2 with compensating element 11 may be installed in cylinder head 4 as an overall component.

FIG. 2A shows fuel injector 2 with compensating element 11 in the unloaded installation position. Compensating element 11 is supported on a shoulder 18 of cylinder head 4 by a first, shorter side piece 17. In the unloaded state, a second, longer side piece 19 of compensating element 11 projects freely into receiving bore 3 of cylinder head 4. Segments 16 rest against housing 14 of fuel injector 2.

FIG. 2B illustrates a loaded state, for example after a clamping shoe (not shown further) that secures fuel injector 2 in receiving bore 3 has been mounted. The pressure presses fuel injector 2 deeper into cylinder head 4, thereby displacing it relative to compensating element 11. Stamped-out segments 16 now rest against a bend 20 of housing 14 of fuel injector 2 where fuel injector 2 widens in a radial direction. A shoulder 21 of fuel injector 2 then rests against longer side piece 19 of compensating element 11, so that side pieces 19 and 17 are pressed together.

If fuel-distributor line 6 is connected to fuel injector 2 as shown in FIG. 2C, displacement and tilting of fuel injector 2 will occur. FIG. 2C indicates an angular offset and a simultaneous lateral displacement, which shifts fuel injector 2 to the left. Because of the length of side piece 17, compensating element 11 remains supported on shoulder 18 of cylinder head 4 despite the lateral displacement. The tilting due to stronger loading on the left side with subsequent plastic and/or elastic deformation of compensating element 11 is likewise easily compensated without any detrimental effect on the function or form of compensating element 11.

Compensating element 11 also effortlessly compensates dynamic oscillations and displacements of fuel injector 2 that occur during operation of the internal combustion engine as a result of vibrations and temperature fluctuations.

FIGS. 3A to 3D show additional alternative specific embodiments of compensating element 11 configured according to the present invention.

Figure 3A:
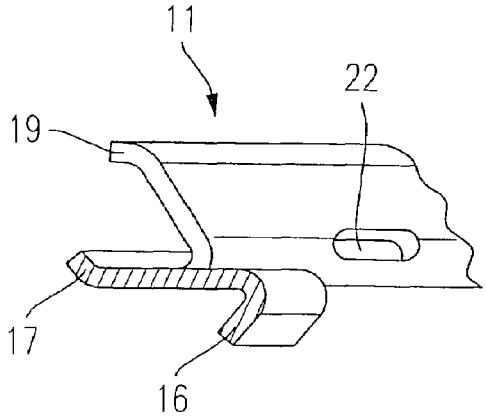
FIG. 3A-D shows detail views of additional exemplary embodiments of compensating elements configured according to the present invention.
Figure 3B:
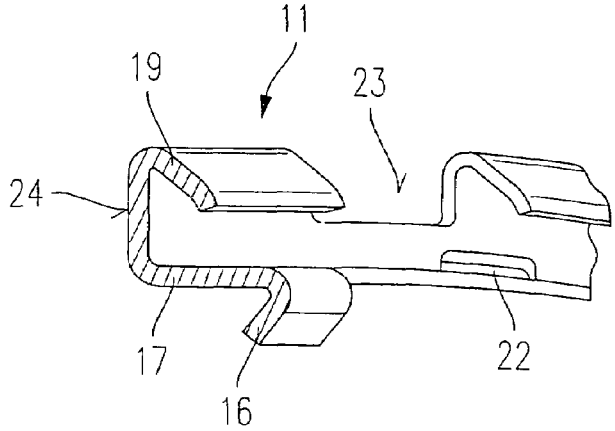

In order to achieve a more flexurally soft compensating element 11, to obtain a progressive spring characteristic of compensating element 11, and to ensure simple manufacturability and installability, undercuts 22 and cut-outs 23 are provided as shown in FIGS. 3A and 3B. Beads or connecting bars (not shown further) may be imprinted for selective reinforcement. The number, shape and position of the individual measures depend on the demands on the characteristic line.

Figure 3C:
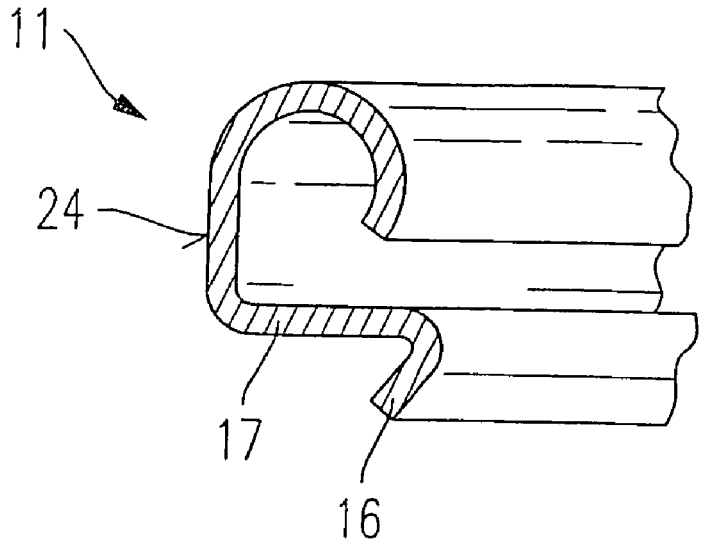
Figure 3D:
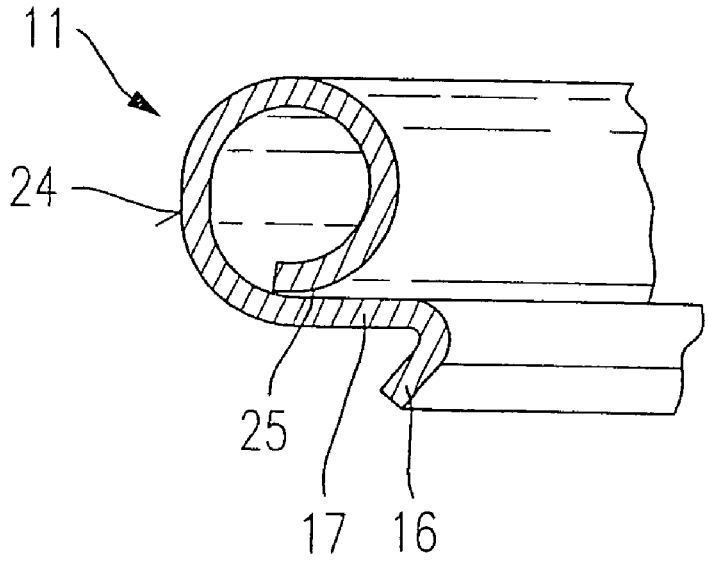

FIG. 3A shows the exemplary embodiment of compensating element 11 configured according to the present invention and described earlier in FIGS. 2A to 2C, while FIGS. 3B to 3D show alternative cross-sectional forms.

The specific embodiment illustrated in FIG. 3B has a three-sided profile with two different angles and a cross-section that is open towards the inside in the direction of shoulder 21 of fuel injector 1. This has the advantage that compensating element 11 will not get stuck so easily during installation but is insertable in receiving bore 3 of cylinder head 4 in a simple manner due to smooth outer side 24.

Similarly advantageous is the variant shown in FIG. 3C, which has an at least partially bent-round cross-section instead of an angular cross-section with multiple bends. The round bend is able to be produced in an especially uncomplicated manner.

If the bending is even more pronounced so that an overlap region 25 forms as shown in FIG. 3D, the friction may also be selectively utilized to form the characteristic line.

Figure 4A:
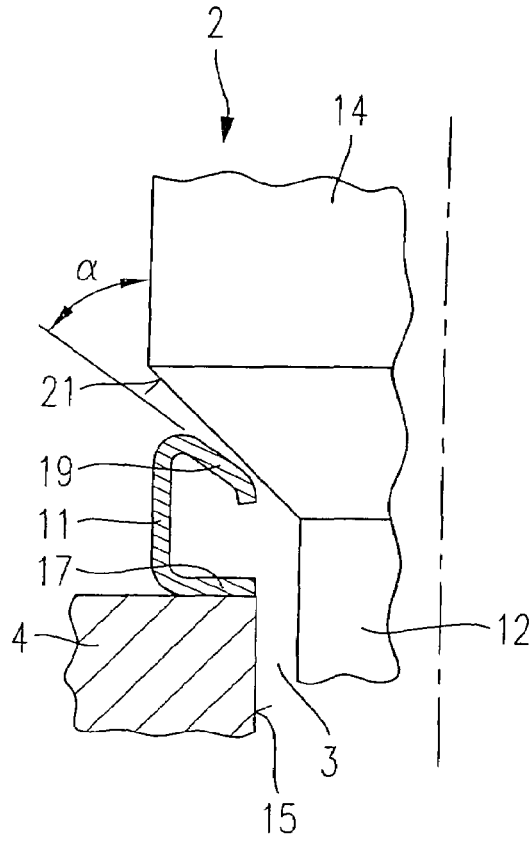
FIG. 4A-B shows an exemplary representation of the deformation of a compensating element of the present invention at an angle $\alpha$.
Figure 4B:
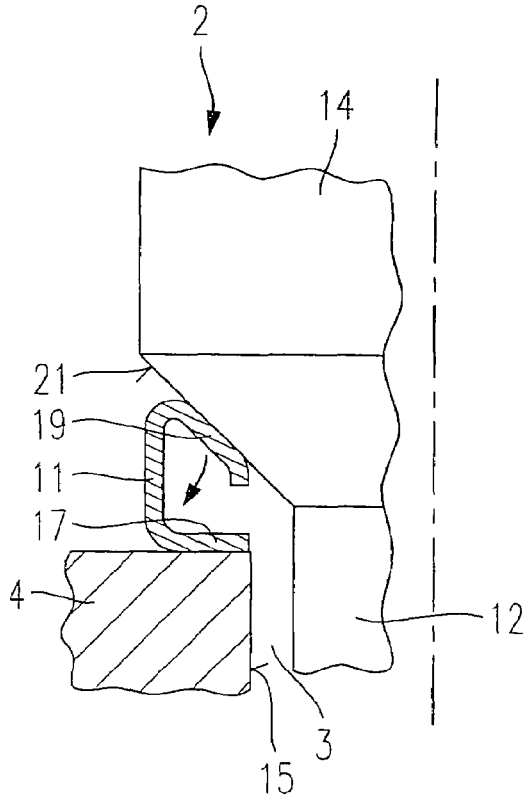
Figure 5A:
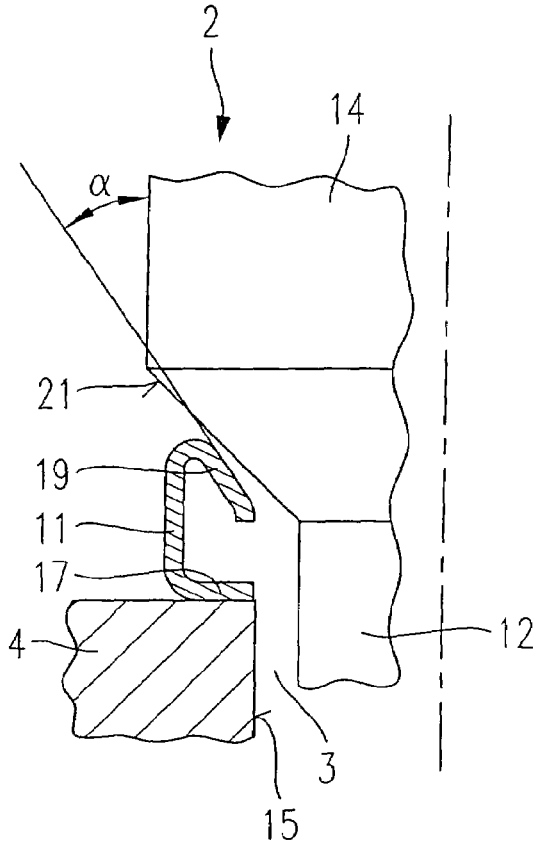
FIG. 5A-B shows an exemplary representation of the deformation of the compensating element according to the present invention shown in FIGS. 4A to 4B, at an angle $\alpha$.
Figure 5B:
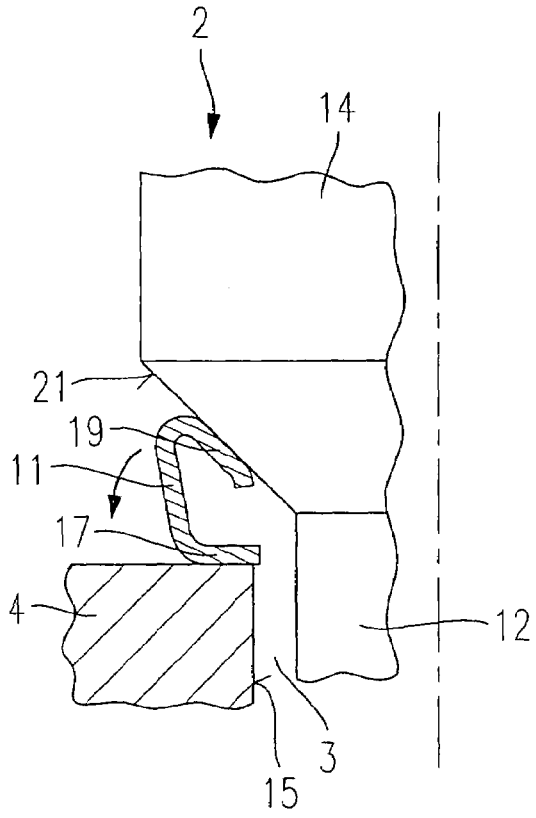

To demonstrate the flexibility of compensating elements 11 configured according to the present invention, two different configurations of the exemplary embodiment of a compensating element 11 designed according to the present invention as shown in FIG. 3B are illustrated in FIGS. 4A and 4B and in FIGS. 5A and 5B with different bending angles $\alpha$.

While angle $\alpha$ between side piece 19, facing fuel injector 2, of compensating element 11 in FIG. 4A and shoulder 21 of fuel injector 2 amounts to approximately 55°, angle $\alpha$ in FIG. 5A is much smaller and amounts to approximately 35°.

This has no adverse effect on the compensating characteristics of compensating element 11, only the bending behavior of compensating element 11 is changed.

From FIG. 4B it can be gathered that side piece 19 facing fuel injector 2 is bent in the load direction at greater angles $\alpha$, whereas in the case of smaller angles $\alpha$ compensating element 11 will be deformed more in the radial direction as shown in FIG. 5B. Nevertheless, the support and compensating effect is equally good in both cases. As a result, little attention must be paid to compliance with precise angular setpoint selections in the bending of side pieces 19 when producing compensating elements 11, since the support effect will be maintained in any event. This makes it possible to produce compensating elements 11 in a very cost-effective manner.

The present invention is not limited to the exemplary embodiments described. In particular, the present invention is applicable to various configurations of fuel injectors 2 such as fuel injectors 2 for the injection into the combustion chamber of an internal combustion engine having self-ignition. All features may be combined with each other in any combination.

What is claimed is:

1. A compensating element for supporting a fuel injector in a cylinder head of an internal combustion engine, comprising:

an annular element capable of being situated between a valve housing of the fuel injector and a wall of a receiving bore of the cylinder head, wherein:

the annular element includes at least a first side piece and a second side piece that are supported on the fuel injector and the cylinder head;

the annular element further includes a plurality of segments that fix the compensating element to the fuel injector, extend into the receiving bore, and limit a lateral movement of the fuel injector in the receiving bore; and at least one of the first side piece and the second side piece is bent in a loaded state of the compensating element.

2. The compensating element as recited in claim 1, wherein the first side piece rests against a shoulder of the cylinder head.

3. The compensating element as recited in claim 1, wherein the second side piece rests against a shoulder of the valve housing.

4. The compensating element as recited in claim 1, wherein the first side piece and the second side piece are at least one of plastically deformable and elastically deformable in response to pressure.

5. The compensating element as recited in claim 1, wherein, in cross section, the first side piece and the second side piece are interconnected in a v-shape.

6. The compensating element as recited in claim 1, wherein the compensating element has a three-sided design.

7. The compensating element as recited in claim 1, wherein the second side piece faces the fuel injector and is at least partially bent round.

8. The compensating element as recited in claim 7, wherein an overlap region is provided between the first side piece and the second side piece.

9. The compensating element as recited in claim 1, wherein an angle formed between the second side piece and the valve housing amounts to between 30° and 60°.

10. The compensating element as recited in claim 1, wherein an angle formed between the second side piece and the valve housing amounts to between 35° and 55°.

11. The compensating element as recited in claim 1, wherein the compensating element has undercuts.

12. The compensating element as recited in claim 1, wherein the compensating element has cut-outs.

13. The compensating element as recited in claim 1, wherein the segments are stamped out of the compensating element and are radially bent inward.

14. The compensating element as recited in claim 1, wherein the compensating element is supported at the valve housing via the segments.

15. The compensating element as recited in claim 1, wherein a spring characteristic of the compensating element is progressive.

* * * * *